US007520263B1

(12) United States Patent
Kim

(10) Patent No.: US 7,520,263 B1
(45) Date of Patent: Apr. 21, 2009

(54) ENGINE TORQUE CONTROL APPARATUS AND ENGINE TORQUE CONTROL METHOD

(75) Inventor: Hyung Kee Kim, Gunpo (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/966,381

(22) Filed: Dec. 28, 2007

(30) Foreign Application Priority Data

Nov. 7, 2007 (KR) ..... 10-2007-0113218

(51) Int. Cl.
*F02D 41/08* (2006.01)
*F02D 41/10* (2006.01)
*F02D 41/12* (2006.01)

(52) U.S. Cl. ..... 123/350; 123/339.1; 123/339.11; 123/339.14; 123/339.18; 701/110

(58) Field of Classification Search ..... 123/350, 123/339.16, 406.2, 406.24, 399, 295, 344, 123/361, 478, 480, 339.1, 339.23, 339.11; 701/84, 85, 54, 86, 87; 477/107, 111
See application file for complete search history.

(56) References Cited

U.S. PATENT DOCUMENTS 4,197,767 A * 4/1980 Leung ..... 477/98
4,951,635 A * 8/1990 Nakaniwa et al. ..... 123/492
5,479,898 A * 1/1996 Cullen et al. ..... 123/350
5,901,682 A * 5/1999 McGee et al. ..... 123/339.19
5,941,210 A * 8/1999 Hill et al. ..... 123/305
6,119,063 A * 9/2000 Hieb et al. ..... 701/110
6,279,531 B1 * 8/2001 Robichaux et al. ..... 123/339.19
6,425,373 B1 * 7/2002 Robichaux et al. ..... 123/436
6,554,091 B2 * 4/2003 Mianzo et al. ..... 180/197
6,718,255 B1 * 4/2004 Okubo ..... 701/110
7,024,298 B2 * 4/2006 Oohori et al. ..... 701/54
7,143,741 B2 * 12/2006 Yagi ..... 123/339.11
7,290,525 B1 * 11/2007 Kapsokavathis et al. .... 123/329

FOREIGN PATENT DOCUMENTS

KR 10-0488703 B1 * 5/2005

* cited by examiner

*Primary Examiner*—Stephen K Cronin
*Assistant Examiner*—Anthony L Bacon
(74) *Attorney, Agent, or Firm*—Morgan, Lewis & Bockius LLP

(57) ABSTRACT

Disclosed are an engine torque control apparatus and an engine torque control method that can stably control engine torque when a variation of a TPS signal converts from an idle state to a part load state or from the part load state to the idle state in an engine, in which an ISA is installed, thereby resolving a problem on drivability, such as a drop of an engine RPM and resolving a problem on drivability, such as flare of an engine RPM, and improving fuel consumption.

5 Claims, 6 Drawing Sheets

ENGINE TORQUE CONTROL APPARATUS AND ENGINE TORQUE CONTROL METHOD

CROSS-REFERENCE TO RELATED APPLICATION

This application claims priority to and the benefit of Korean Patent Application No. 10-2007-0113218, filed in the Korean Intellectual Property Office on Nov. 7, 2007, the entire contents of which are incorporated herein by reference.

BACKGROUND OF THE INVENTION (a) Field of the Invention

The present invention relates to an engine torque control apparatus, and in particular, to an engine torque control apparatus and an engine torque control method that stably control engine torque when, in an engine in which an ISA (Idle Speed Actuator) is installed, a variation of a TPS (Throttle Position Sensor) signal converts from an idle state to a part load state or from the part load state to the idle state.

(b) Description of the Related Art

Generally, an ISA is installed in an engine that is mounted on a vehicle. The ISA operates by a PWM (Pulse Width Modulation) signal from an engine control apparatus and adjusts the amount of air flowing into a combustion chamber so as to maintain a target engine RPM on an idle control condition of the engine.

The engine control apparatus analyzes a TPS signal and when a throttle valve is closed, the engine control apparatus determines the engine to be in an idle state, and when the throttle valve is opened, determines the engine to be in a part load state according to the opening degree of the throttle valve.

In case that a variation in load occurs, the engine control apparatus simultaneously adjusts the air amount of the ISA and the ignition timing so as to maintain the target engine RPM.

The conventional engine torque control operation when the engine mounted on the vehicle is changed from the idle state to the part load state will be described with reference to FIG. 5.

As shown in FIG. 5A, if the variation of the TPS signal converts from an idle period to a part load (P/L) period, a control is performed to cancel a torque restriction amount (TQ restriction amount) set in the idle period, and to reduce the ISA opening, as shown in FIG. 5B. This is because the ignition timing is advanced to compensate torque so as to maintain the maximum torque when a driving condition converts from the idle period to the part load (P/L) period, as shown in FIG. 5C.

That is, as shown in FIG. 6, the torque restriction amount set on the idle condition is rapidly cancelled in the part load period, and the ignition timing is rapidly advanced to the normal ignition timing.

In this case, since a transient period is too short, the engine torque is not accurately controlled through the control of the air amount of the ISA and the ignition timing. Accordingly, the engine torque excessively varies, which results in the drop of the engine RPM.

As shown in FIG. 7, when a driving condition converts from the part load condition to the idle state, the torque restriction amount is rapidly applied when the engine enters the idle state, and the air amount of the ISA is rapidly increased. Then, the ignition timing is immediately delayed by the amount corresponding to the torque restriction amount.

In this case, since the transient period is also too short, the engine torque excessively varies, and overshoot occurs in the engine RPM, which causes a loss of fuel consumption.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an engine torque control apparatus and an engine torque control method, having advantages of minimizing a variation of engine torque by effectively controlling a torque restriction amount set on an idle condition when a driving condition converts from the idle condition to a part load condition, thereby resolving a problem on drivability, such as a drop of an engine RPM.

The present invention has also been made an effort to provide an engine torque control apparatus and an engine torque control method, having advantages of minimizing a variation of engine torque by effectively controlling setting of a torque restriction amount when a driving condition converts from a part load condition to an idle condition, thereby resolving a problem on drivability, such as flare of an engine RPM, and improving fuel consumption.

An exemplary embodiment of the present invention provides an engine torque control apparatus.

The engine torque control apparatus includes a driving request detecting unit that analyzes a TPS (Throttle Position Sensor) signal and detects whether or not a variation in a load occurs; an RPM detecting unit that detects an engine RPM; a torque arithmetic unit that determines an engine torque control value according to the variation in the load and controls engine torque by adjusting an air amount of an ISA (Idle Speed Actuator), advancing or delaying an ignition timing, and adjusting a fuel injection amount; an air amount adjusting unit that outputs an ISA PWM (Pulse Width Modulation) signal according to a control signal from the torque arithmetic unit and adjusts the air amount of the ISA on the basis of the variation in the load; an ignition timing adjusting unit that advances or delays the ignition timing according to the control signal from the torque arithmetic unit on the basis of the variation in the load; and a fuel amount adjusting unit that adjusts a fuel amount to be injected to individual combustion chambers according to the control signal from the torque arithmetic unit.

Another embodiment of the present invention provides an engine torque control method.

The engine torque control method includes: analyzing a TPS signal in an engine start-up state and determining whether or not a variation in a load occurs; when a driving condition converts from an idle state to a part load state, linearly setting a first transient period and a torque restriction cancellation value, and linearly canceling torque restriction in the first transient period; setting a first engine RPM weight value based on a target engine RPM, and setting a first alternator load weight value; applying the torque restriction cancellation value set in the setting of the torque restriction cancellation value, and the first engine RPM weight value and the first alternator load weight value set in the setting of the first engine RPM weight value and the first alternator load weight value, and determining a first final engine torque so as to control an air amount of an ISA and an ignition timing; if it is determined in the analyzing of the TPS signal that a driving condition converts from the part load state to the idle state, linearly setting a second transient period and a torque restriction amount, and linearly performing torque restriction in the second transient period; setting a second engine RPM weight value based on the target engine RPM, and setting a second alternator load weight value; and applying the torque restriction amount set in the setting of the torque restriction amount, and the second engine RPM weight value and the second alternator load weight value set in the setting of the second engine RPM weight value and the second alternator load weight value, and determining a final engine torque so as to control the air amount of the ISA and the ignition timing.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
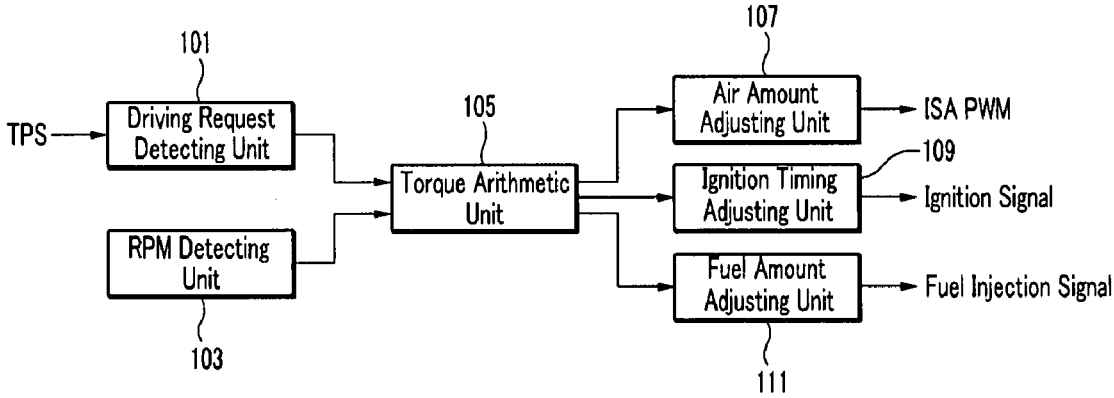
FIG. 1 is a block diagram showing the schematic configuration of an engine torque control apparatus according to an exemplary embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

<Description of Reference Numerals Indicating Primary Elements in the Drawings>

101: driving request detecting unit 103: RPM detecting unit

105: torque arithmetic unit 107: air amount adjusting unit

109: ignition timing adjusting unit 111: fuel amount adjusting unit

DETAILED DESCRIPTION OF THE EMBODIMENTS

Hereinafter reference will not be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIG. 1 is a block diagram showing the schematic configuration of an engine torque control apparatus according to an exemplary embodiment of the present invention.

As shown in FIG. 1, an engine torque control apparatus according to an exemplary embodiment of the present invention includes a driving request detecting unit 101, an RPM detecting unit 103, a torque arithmetic unit 105, an air amount adjusting unit 107, an ignition timing adjusting unit 109, and a fuel amount adjusting unit 111.

The driving request detecting unit 101 analyzes a TPS signal, detects a driving request of a driver, that is, whether or not a change from an idle condition to a part load condition or from the part load condition to the idle condition occurs, and transmits the detected information to the torque arithmetic unit 105.

The RPM detecting unit 103 detects an engine RPM from positional information of a crankshaft or angular information of a camshaft and transmits the detected information to the torque arithmetic unit 105.

The torque arithmetic unit 105 determines an engine torque control value on the base of a detected variation in a load from the driving request detecting unit 101. Then, the torque arithmetic unit 105 stably controls engine torque according to the variation in the load by adjusting an air amount of an ISA, advancing or delaying an ignition timing, and/or adjusting a fuel injection amount.

The torque arithmetic unit 105 delays the ignition timing to maintain a target engine RPM on the idle condition and to improve load responsiveness, and uses a torque restriction to increase the air amount of the ISA. In addition, if a load operation is detected, the torque arithmetic unit 105 compensates the ignition timing and then adjusts the air amount of the ISA as explained below in detail.

To efficiently control the engine when a driving condition converts from the idle state to the part load (P/L) state in a small throttle opening range, the torque arithmetic unit 105 sequentially cancels the torque restriction amount so as to prevent a variation in the engine torque.

In addition, to efficiently control the engine when a throttle valve is closed and a driving condition converts from the part load state to the idle state, the torque arithmetic unit 105 sequentially increases the torque restriction amount so as to prevent the variation in the engine torque.

While canceling and increasing sequentially the torque restriction amount, the torque arithmetic unit 105 sets and applies a weight value in consideration of an alternator load and a weight value based on a target engine RPM and a current engine RPM.

The air amount adjusting unit 107 outputs an ISA PWM signal according to a control signal from the torque arithmetic unit 105 and adjusts the air amount flowing into combustion chambers through an ISA (not shown), thereby stably maintaining the output torque of the engine.

The ignition timing adjusting unit 109 advances or delays the ignition timing according to the control signal from the torque arithmetic unit 105 so as to stably maintain the output torque of the engine when a driving condition converts from the idle state to the part load state or from the part load state to the idle state.

The fuel amount adjusting unit 111 adjusts a fuel amount to be injected to each of the combustion chambers according to the control signal from the torque arithmetic unit 105, thereby stably maintaining the output torque of the engine.

Figure 2:
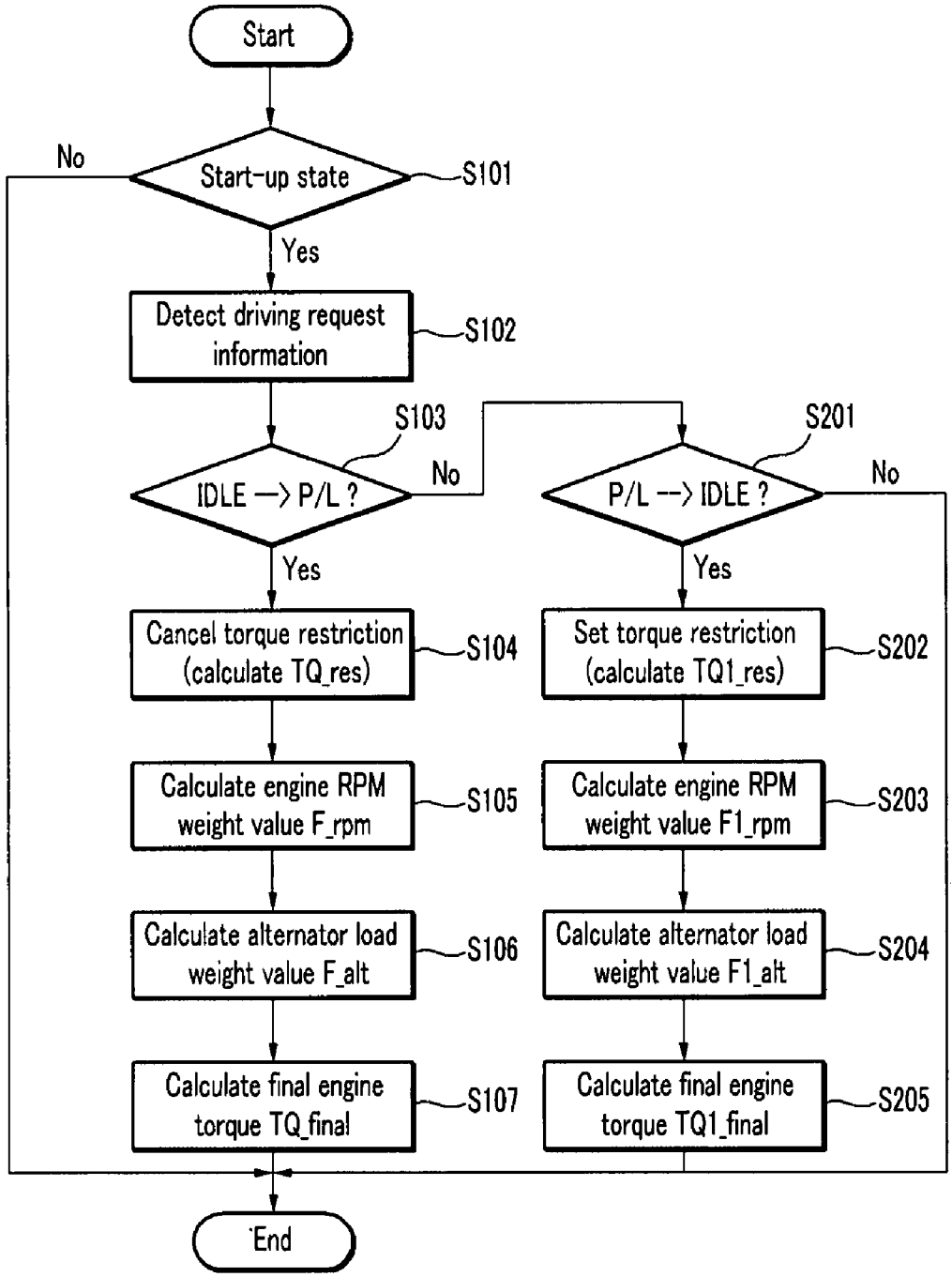
FIG. 2 is a flowchart illustrating a torque control process in an engine torque control apparatus according to an exemplary embodiment of the present invention.

Next, the engine torque control operation in the engine torque control apparatus having the above-described functions and features will be described with reference to FIGS. 2 to 4 as exemplary embodiments of the present invention.

If the engine is kept to be in a start-up state (Step S101), the driving request detecting unit 101 analyzes the TPS signal and transmits driving request information of driver as the analysis result to the torque arithmetic unit 105 (Step S102).

The torque arithmetic unit 105 controls the output torque of the engine according to the transmitted driving request information and, from the driving request information, determines whether or not a driving condition converts from the idle state to the part load state at first (Step S103).

Figure 3:
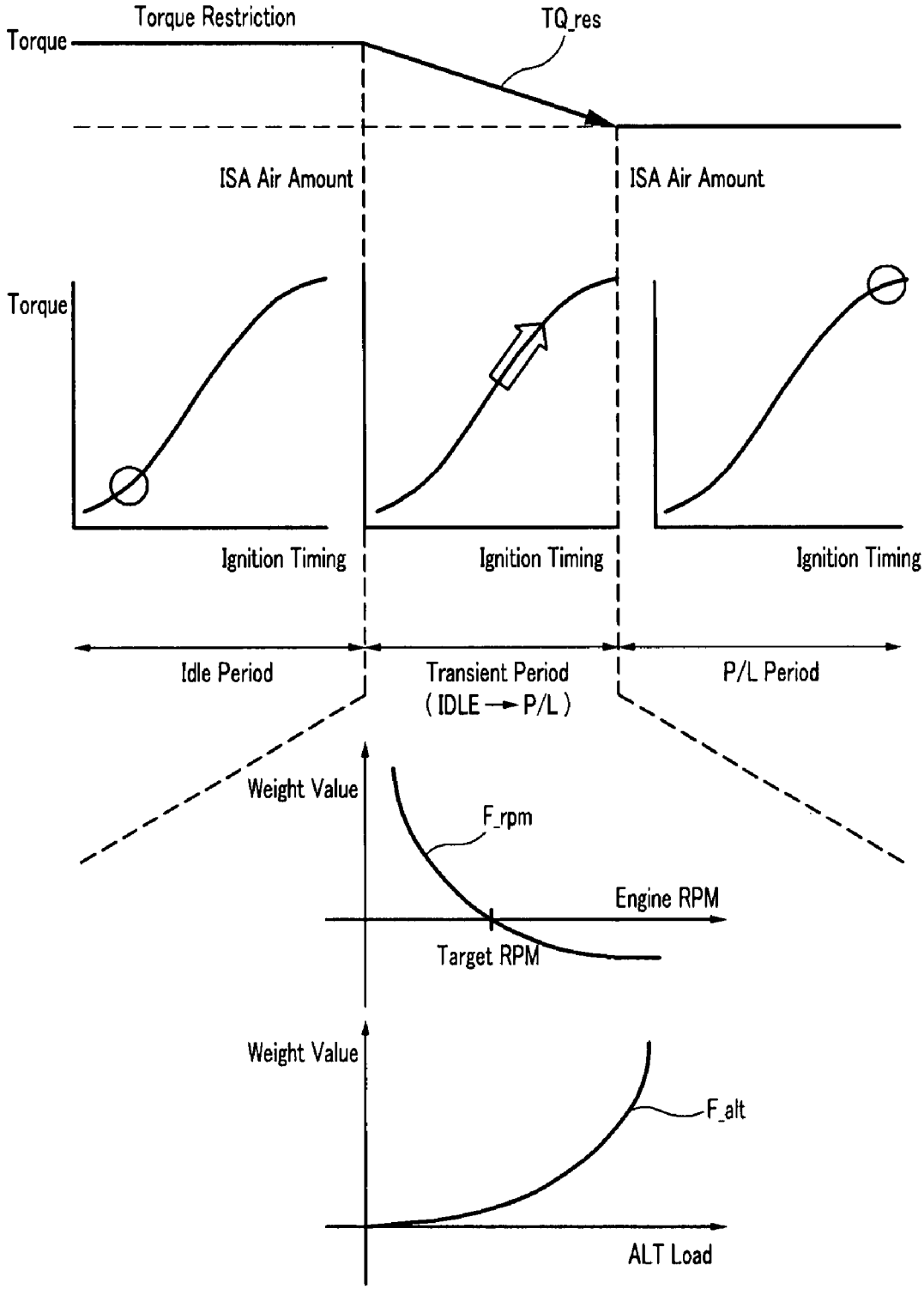
FIG. 3 is a diagram illustrating an engine torque control relationship when a variation in a load converts from an idle period to a part load period according to an exemplary embodiment of the present invention.

In the idle state where the TPS signal is "0", the torque arithmetic unit 105 sets the torque restriction amount so as to efficiently maintain the idle load responsiveness, and controls the engine output to be in the idle state, as shown in FIG. 3.

At this time, to maintain the target engine RPM and improve the load responsiveness, a method that increases the air amount of the ISA by the air amount adjusting unit 107, instead of delaying the ignition timing, is applied.

In addition, for the sake of rapid load response, the ignition timing is delayed by a predetermined amount (torque restriction amount). Then, if the load operation is detected, a control is performed to compensate the ignition timing and then to sequentially adjust the air amount of the ISA.

In Step S103, if it is determined from the driving request information transmitted from the driving request detecting unit 101 that a driving condition converts from the idle state to the part load state, a transient period from the idle state to the part load state is set, and a cancellation value of the torque restriction amount TQ_res in the transient period is linearly determined. Then, the torque restriction amount is cancelled on the basis of the determined cancellation value. In this way, the engine RPM is prevented from being rapidly changed (Step S104).

For example, during a period in which the value of the TPS signal is in a range of 0 to 5%, the weight value is set according to the engine RPM and the alternator load to determine the cancellation value of the torque restriction amount. If the value of the TPS signal is larger than 5%, the torque restriction amount is completely cancelled.

Next, an engine RPM weight value F_rpm is determined based on the target engine RPM. The engine RPM weight value F_rpm is calculated on the basis of the target engine RPM. Specifically, the engine RPM weight value F_rpm is highly weighed if the engine RPM is lower than the target engine RPM. In contrast, if the engine RPM is higher than the target engine RPM, the engine RPM weight value is weighed to a negative value (Step S105).

The weight value of the target engine RPM is set in a hyperbolic curve shape.

Next, an alternator load weight value F_alt is set (Step S106).

The larger the alternator load is, the more highly the alternator load weight value F_alt is weighed.

As described above, if the cancellation value of the torque restriction amount, the engine RPM weight value, and the alternator load weight value are determined, a final engine torque TQ_final is calculated by Equation 1 on the basis of the determined values, and the calculated final engine torque TQ_final is applied for engine control (Step S107).

$$TQ_final = TQ_res \times F_rpm \times F_alt \quad \text{(Equation 1)}$$

In the part load (P/L) state, the torque restriction amount is completely cancelled, and the ignition timing is allowed to follow the normal ignition timing. In addition, the required torque amount is determined according to the TPS signal so as to control the ISA opening and the ignition timing, thereby maintaining the output torque of the engine.

In Step S103, if it is determined from the driving request information of driver that a driving condition does not convert from the idle state to the part load state, it is determined whether or not a driving condition converts from the part load state to the idle state (Step S201).

Figure 4:
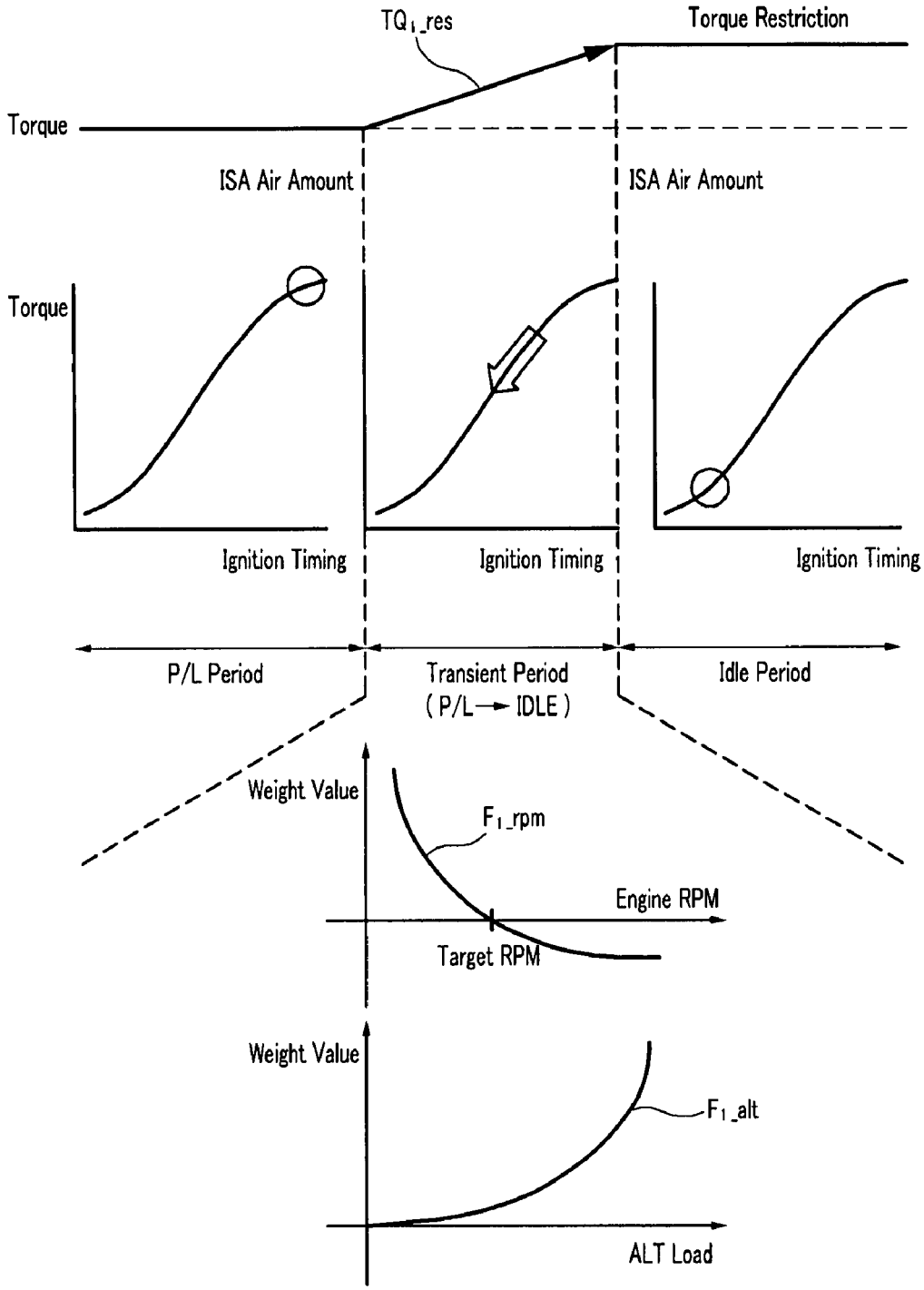
FIG. 4 is a diagram showing an engine torque control relationship when a variation in a load converts from a part load period to an idle period according to an exemplary embodiment of the present invention.
Figure 5:
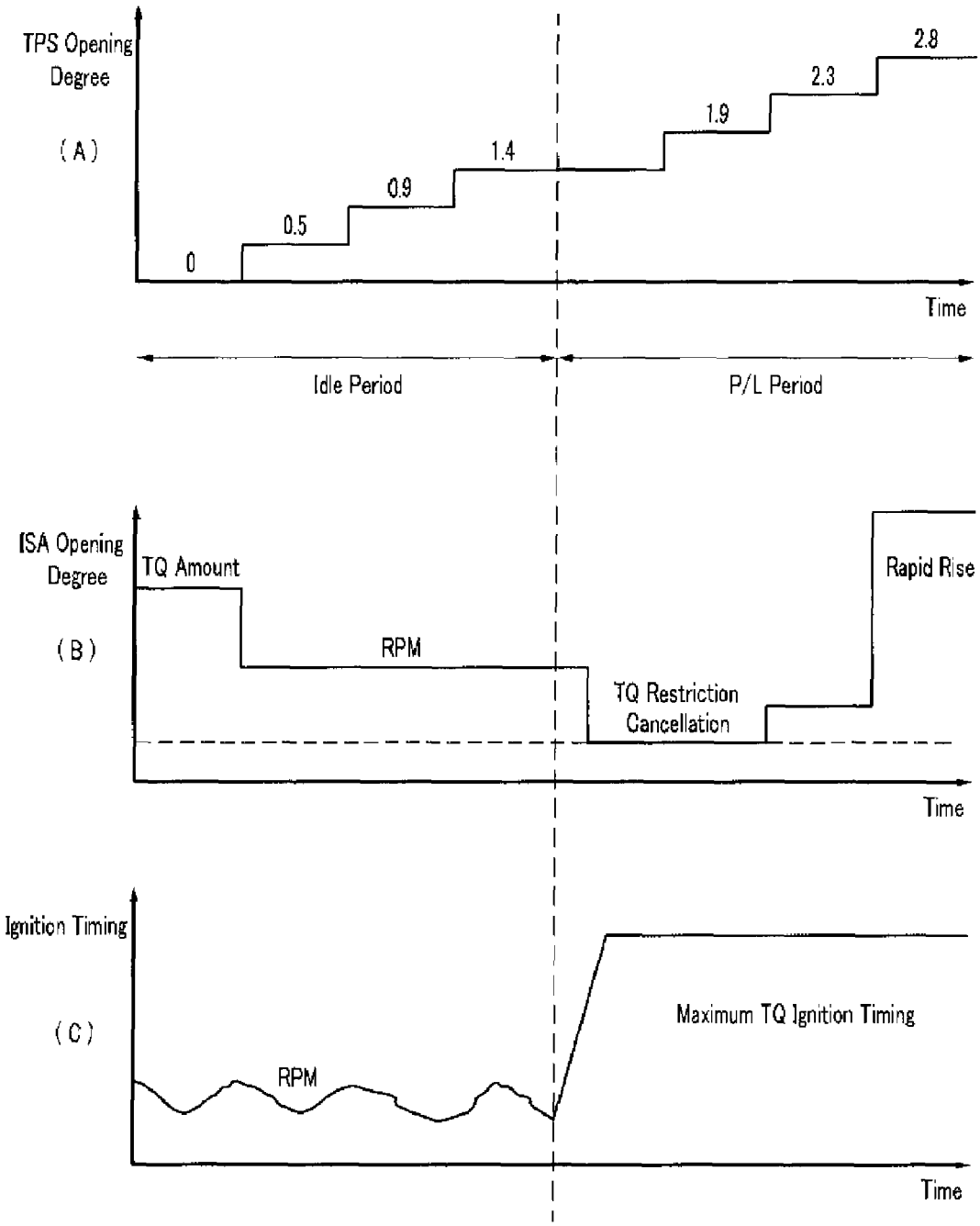
FIG.5 (PRIOR ART)
FIG. 5 is a diagram showing the relationship between an ISA opening degree and an ignition timing according to a TPS opening degree in a conventional engine control apparatus.
Figure 6:
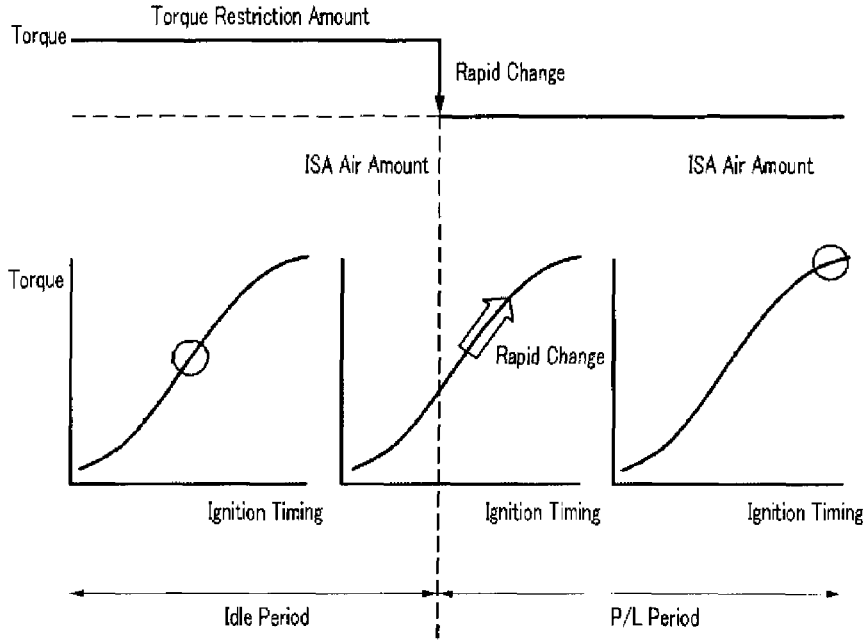
FIG.6 (PRIOR ART)
FIG. 6 is a diagram showing a variation in engine torque in a conventional engine control apparatus when a driving condition converts from an idle period to a part load period.
Figure 7:
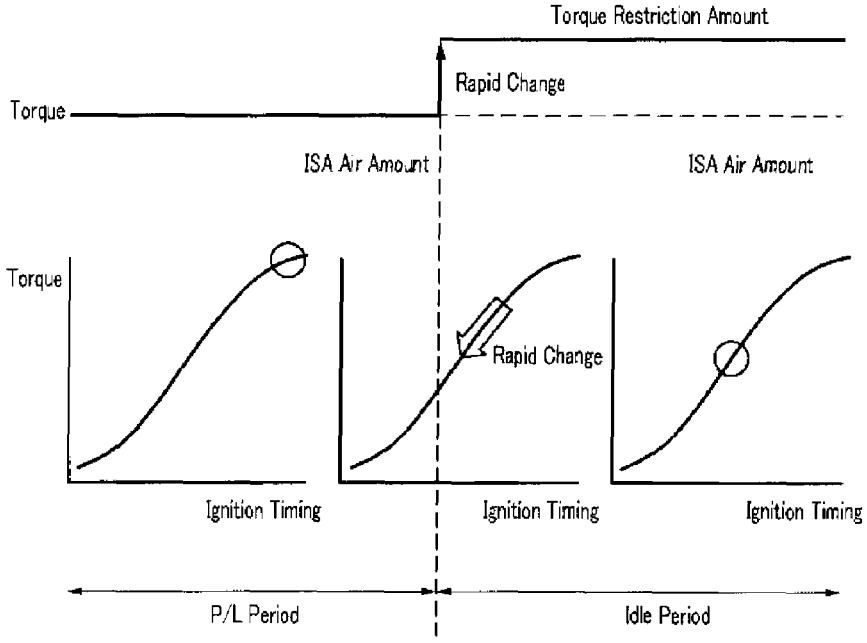
FIG.7 (PRIOR ART)
FIG. 7 is a diagram showing a variation in engine torque in a conventional engine control apparatus when a driving condition converts from a part load period to an idle period.

In Step S201, if it is determined that a driving condition converts from the part load state to the idle state, a transient period is set, and a slope of torque restriction amount TQ1_res in the transient period is determined (Step S202), as shown in FIG. 4.

The slope of torque restriction amount TQ1_res is linearly set such that it is set to "0" immediately after a driving condition converts from the part load state to the idle state, and then it reaches the maximum value 100% when a predetermined time, preferably, 3 seconds, elapses.

Subsequently, an engine RPM weight value F1_rpm is set on the basis of the target engine RPM (Step S203).

The engine RPM weight value F1_rpm is weighed on the basis of the target engine RPM. Specifically, the engine RPM weight value F1_rpm is highly weighed if the engine RPM is lower than the target engine RPM. If the engine RPM is higher than the target engine RPM, the engine RPM weight value is weighed to a negative value.

Next, a weight value F1_alt is set according to an alternator load. The larger the alternator load is, the more highly the alternator load weight value F1_alt is set (Step S204).

As described above, if the torque restriction amount, the engine RPM weight value, and the alternator load weight value are determined, a final engine torque TQ1_final is calculated by Equation 2 on the basis of the determined values, and the calculated final engine torque TQ1_final is applied for engine control (Step S205).

$$TQ1_final = TQ1_res \times F1_rpm \times F1_alt \quad \text{(Equation 2)}$$

Subsequently, in the idle state, the output torque of the engine is adjusted according to a predetermined torque restriction amount.

According to the embodiment of the present invention, when a driving condition converts from the idle condition to the part load condition, a variation in torque can be minimized, thereby preventing the drop of the engine RPM. In addition, when a driving condition converts from the part load condition to the idle condition, occurrence of a flare of the engine RPM can be prevented, thereby improving stability of the engine torque and fuel consumption.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An engine torque control method, comprising:

analyzing a TPS signal in an engine start-up state and determining whether or not a variation in a load occurs;

when a driving condition converts from an idle state to a part load state, linearly setting a first transient period and a torque restriction cancellation value, and linearly canceling the torque restriction amount in the first transient period;

setting a first engine RPM weight value based on a target engine RPM, and setting a first alternator load weight value;

applying the torque restriction cancellation value set in the setting of the torque restriction cancellation value, and the first engine RPM weight value and the first alternator load weight value set in the setting of the first engine RPM weight value and the first alternator load weight value, and determining a first final engine torque so as to control an air amount of an ISA and an ignition timing;

if it is determined in the analyzing of the TPS signal that a driving condition converts from the part load state to the idle state, linearly setting a second transient period and a torque restriction amount, and linearly performing torque restriction in the second transient period;

setting a second engine RPM weight value based on the target engine RPM, and setting a second alternator load weight value; and applying the torque restriction amount set in the setting of the torque restriction amount, and the second engine RPM weight value and the second alternator load weight value set in the setting of the second engine RPM weight value and the second alternator load weight value, and determining a second final engine torque so as to control the air amount of the ISA and the ignition timing.

2. The engine torque control method of claim 1, wherein the torque restriction cancellation value set in the setting of the torque restriction cancellation value maintains linearity during a period in which the TPS signal is in a range of 0 to 5%, and is set to 100% during a period in which the TPS signal is larger than 5%.

3. The engine torque control method of claim 1, wherein, in the setting of the first engine RPM weight value and the setting of the second engine RPM weight value, the engine RPM weight value is highly weighed if the engine RPM is lower than the target engine RPM, and is set to a negative value if the engine RPM is higher than the target engine RPM.

4. The engine torque control method of claim 1, wherein, in the setting of the first alternator load weight value and the setting of the second alternator load weight value, the larger the alternator load is, the more highly the alternator load weight value is set.

5. The engine torque control method of claim 1, wherein, in the idle state, the applying of the torque restriction amount, the second engine RPM weight value, and the second alternator load weight value, and the determining of the second final engine torque includes delaying the ignition timing so as to maintain the target engine RPM and load responsiveness, using the torque restriction so as to increase the air amount of the ISA, and when a load operation is detected, compensating the ignition timing and then adjusting the air amount of the ISA.

* * * * *